US006748784B1

(12) United States Patent
Chubb et al.

(10) Patent No.: US 6,748,784 B1
(45) Date of Patent: Jun. 15, 2004

(54) PORTABLE SHEET BENDING BRAKE

(75) Inventors: Arthur Bryant Chubb, Dexter, MI (US); Douglas G. Break, Livonia, MI (US); James E. Suyak, Riverview, MI (US); Arthur Bryant Chubb, II, Dexter, MI (US); Michael John Chubb, Carleton, MI (US); Paul James Kosch, Spring Lake, MI (US)

(73) Assignee: J-Dan, Inc., Romulus, MI (US)

( * ) Notice: Subject to any disclaimer, the term of this patent is extended or adjusted under 35 U.S.C. 154(b) by 0 days.

(21) Appl. No.: 10/352,815

(22) Filed: Jan. 28, 2003

Related U.S. Application Data

(62) Division of application No. 09/793,062, filed on Feb. 26, 2001, now Pat. No. 6,532,789.

(51) Int. Cl.[7] ..... B21D 5/04
(52) U.S. Cl. ..... 72/319; 72/419; 72/452.4
(58) Field of Search ..... 72/319–323, 316, 72/312, 452.4, 419

(56) References Cited

U.S. PATENT DOCUMENTS

| | | | | | |
|---|---|---|---|---|---|
| 2,478,854 | A | * | 8/1949 | Webb | 72/319 |
| 3,694,043 | A | * | 9/1972 | Tellson | 384/578 |
| 4,372,142 | A | | 2/1983 | Rhoades | 72/319 |
| 4,489,583 | A | | 12/1984 | Rhoades | 72/319 |
| 4,494,397 | A | | 1/1985 | Rhoades | 72/319 |
| 4,512,174 | A | | 4/1985 | Rhoades | 72/319 |
| 4,566,304 | A | | 1/1986 | Van Cleave, Eugene H. et al. | 72/319 |
| 4,651,553 | A | | 3/1987 | Rhoades | 72/319 |
| 4,671,094 | A | | 6/1987 | Break | 72/319 |
| 4,918,966 | A | | 4/1990 | Raccioppi, Jr. | 72/319 |
| 5,353,620 | A | | 10/1994 | Olsen et al. | 72/319 |
| 5,505,069 | A | | 4/1996 | Break et al. | 72/319 |
| 5,761,939 | A | | 6/1998 | Spencer et al. | 72/307 |
| 6,070,696 | A | | 6/2000 | Chubb et al. | |
| 6,082,164 | A | | 7/2000 | Palmer | 72/319 |

* cited by examiner

*Primary Examiner*—Daniel C. Crane
(74) *Attorney, Agent, or Firm*—Reising, Ethington Barnes, Kisselle, P.C.

(57) ABSTRACT

A portable sheet bending brake has a support frame with spaced longitudinally extending rails and a plurality of frame sections interconnecting the rails. A clamp member is carried by the lower arms of the frame sections, and an anvil member is carried by arms pivotally coupled to the upper arms of the frame sections. A bend member is pivotally mounted to the clamp member for bending over the anvil member sheet material clamped between the anvil and base members. A pair of longitudinally spaced handles are pivotally mounted to the bend member for pivoting into a channel on the bend member out of position to facilitate transport and storage of the brake. A shaft extends between bearings on the frame section arms, and has diametrically opposed longitudinally extending channels. Eccentric cams are received on the shaft, with diametrically opposed lugs received in the channels for automatically timing the cams with respect to the shaft, for pivoting the arms and the anvil member into clamping engagement with the base member. A stand supports the frame above the ground, and a table is mounted to the stand by four-bar linkages for movement between a lowered position beneath the brake and a raised position adjacent to the bend member while maintaining horizontal orientation of the table.

11 Claims, 7 Drawing Sheets

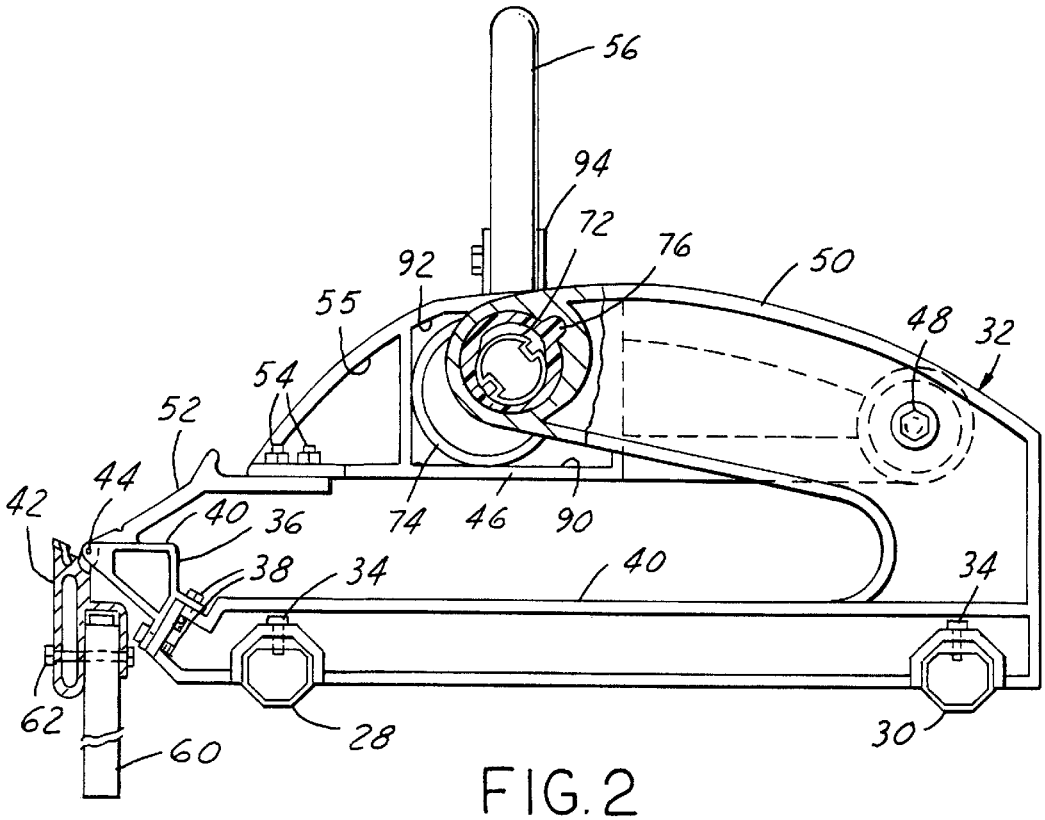
FIG. 2
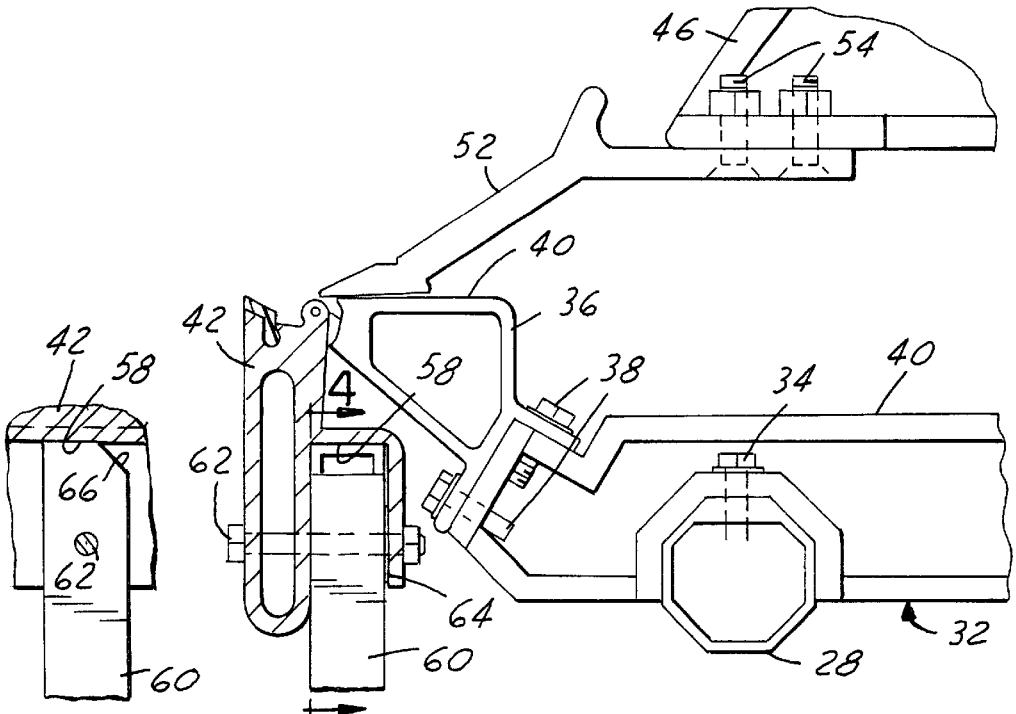
FIG. 4
FIG. 3

PORTABLE SHEET BENDING BRAKE

This application is a division of application Ser. No. 09/793,062 filed Feb. 26, 2001 now U.S. Pat. No. 6,532,789.

The present invention relates to portable sheet bending brakes.

BACKGROUND AND SUMMARY OF THE INVENTION

Sheet bending brakes heretofore proposed generally include a support frame formed by a pair of elongated support rails and a plurality of C-shaped frame sections that interconnect the rails. An elongated base member is mounted on the lower arms of the frame sections to form a clamp surface, and an elongated anvil member is mounted on bars pivotally secured to the upper arms of the frame sections for clamping sheet material against a clamp surface on the base member. A bend member is pivotally mounted to the base member for bending over the anvil member sheet material clamped between the anvil member and the base member. Among problems associated with conventional portable sheet bending brakes of this type is difficulty in storing and transporting the brake between jobs. Manufacturers recommend against suspending the brakes from hangers that engage the frame rails, which can bend or distort the brakes. Handles on the bend member must be removed prior to transport, still leaving mounting posts or the like extending beneath the support plane of the frame, which can catch on clothing or frame support surfaces. Another problem with conventional brakes lies in the fact that some assembly is typically required before the brake is ready for use by a purchaser.

The present invention provides a number of aspects or improvements in sheet bending brakes. These aspects or improvements may be implemented separately from each other, or more preferably in combination with each other, as in the preferred embodiment of the invention herein disclosed. In accordance with one aspect of the invention, the handle or handles coupled to the bend member of the sheet bending brake, to assist an operator in manually bending the sheet material over the anvil member, are mounted to the bend member to pivot between a position extending from the bend member for use by an operator and a position adjacent to the bend member. In the latter position, the handle or handles are effectively folded out of the way and do not obstruct storage of the bending brake. In accordance with another aspect of the invention, the arms that pivotally mount the anvil member to the frame sections have handle openings adjacent to the anvil member for grasping by a user to facilitate transport of the brake. Yet another aspect of the invention contemplates securement of the frame sections to the frame rails on three sides of the rails, so that the brake may be suspended from hooks by the front or rear rail, for example, without distorting or bending the rear rail or the brake assembly.

In accordance with another aspect of the present invention, a shaft extends through bearings on the upper arms of the frame sections. Eccentric cams are mounted on the shaft and engage the anvil member support arms for pivoting the support arms and the anvil member toward and away from the clamp member as a function of rotation of the shaft. The shaft has a non-uniform lateral cross section, preferably including diametrically opposed longitudinally extending channels parallel to the axis of the shaft. The eccentric cams are of integrally formed construction, and have non-uniform openings, preferably with diametrically opposed lugs, received over the shaft so that the cams are automatically timed with respect to each other and with respect to the shaft upon assembly of the cams to the shaft. This aspect of the invention addresses problems in prior art constructions of this type, in which the cams are mounted on collars that must be rotationally timed with respect to the shaft, and in which the cams may readily become misaligned and mistimed during use of the bending brake. The shaft support bearings mounted in the upper arms of the frame sections have elongated tapering openings for accommodating movement of the shaft to clamp the anvil member and the sheet material in position. These bearings have tapering outer surfaces that cooperate with tapering outer surfaces in the frame section arms to facilitate manufacture in that the bearings may be inserted in the arms in only one direction. The elongated bearing slots allow clamping of a wide range of sheet material thicknesses, are self-adjusting, and do not require manual adjustment with wear as weather changes.

Yet another aspect of the present invention contemplates a stand and table assembly for a sheet bending brake, including a stand for mounting the brake above a horizontal surface such as the ground, and a table mounted on the stand for movement between a lowered position beneath the brake and a raised position adjacent to the clamp surface of the brake. In the preferred embodiment, the stand includes multi-bar linkages mounting the table to the frame for maintaining horizontal orientation of the table at and between the lowered and raised positions. The frame includes locks for locking the table in the raised position, and springs for assisting manual raising of the table from the lowered to the raised position.

BRIEF DESCRIPTION OF THE DRAWING

The invention, together with additional objects, features and advantages thereof, will be best understood from the following description, the appended claims and the accompanying drawings in which:

FIG. 2 is a partially sectioned side elevational view of the sheet bending brake illustrated in FIG. 1;

FIG. 3 is a fragmentary partially sectioned side elevational view on an enlarged scale of a portion of the sheet bending brake illustrated in FIG. 2;

FIG. 4 is a fragmentary partially sectioned front elevational view taken substantially along the line 4—4 in FIG. 3;

DETAILED DESCRIPTION OF THE PREFERRED EMBODIMENTS

Figure 1:
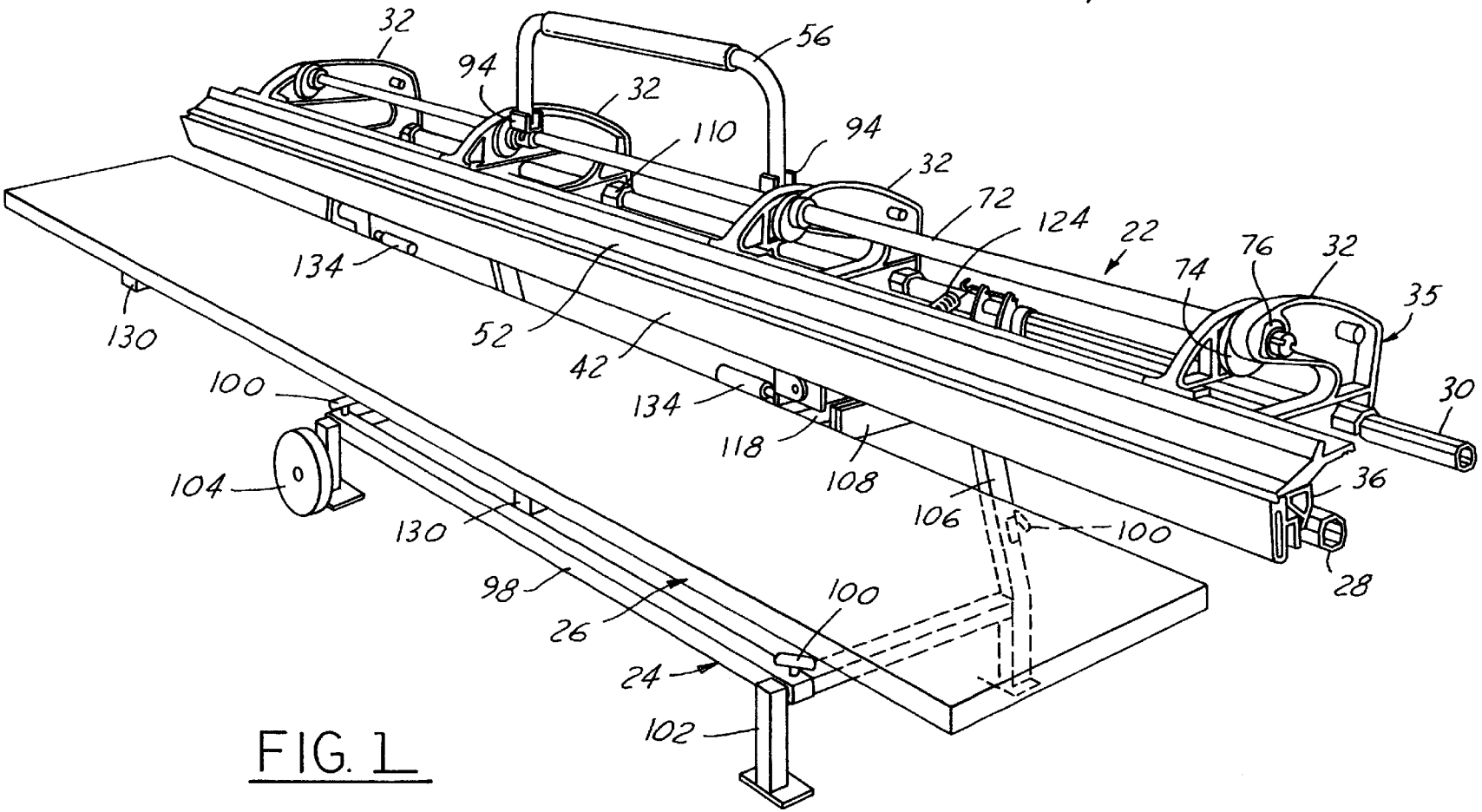
FIG. 1 is a front perspective view of a sheet bending brake with stand and table assembly in accordance with a presently preferred embodiment of the invention.
Figure 5:
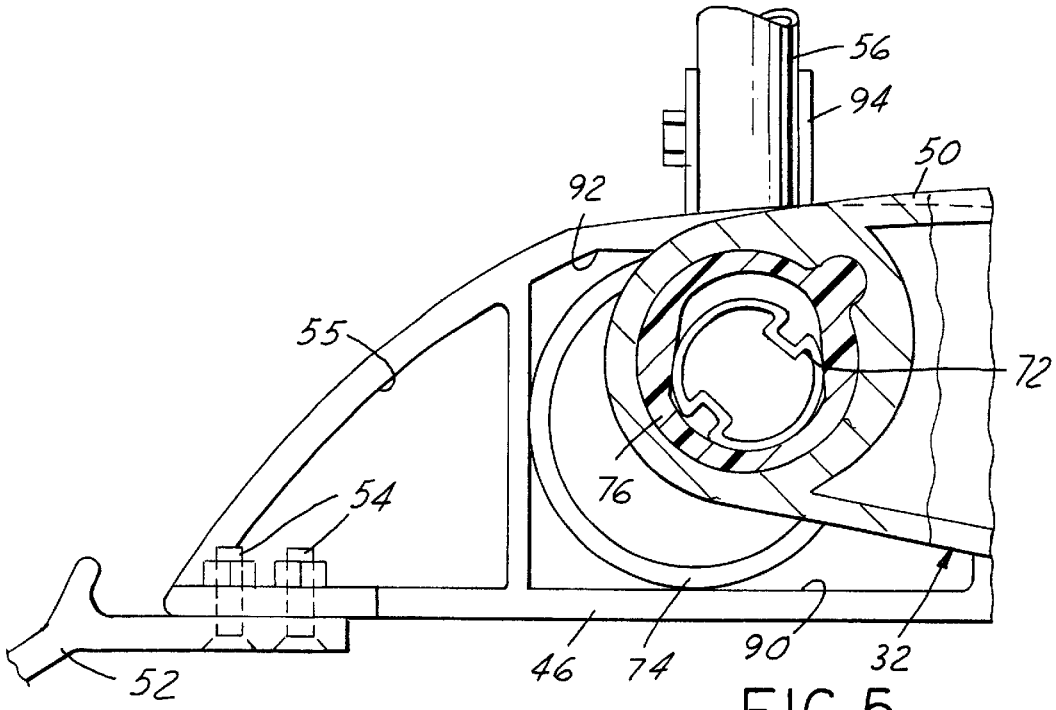
FIG. 5 is a fragmentary partially sectioned elevational view on an enlarged scale of a portion of the sheet bending brake illustrated in FIG. 2.

FIG. 1 illustrates a sheet bending brake, stand and table assembly 20 as including a sheet bending brake 22 mounted on a stand 24 that also carries a table 26. Referring to FIGS. 1–6, brake 22 includes an elongated front rail 28 and an elongated rear rail 30 parallel to rail 28. A plurality of frame sections 32 are disposed in a longitudinally spaced array and secured as by screws 34 to rails 28, 30. Rails 28, 30 and frame sections 32 thus form a rigid elongated generally rectangular support frame 35, in which frame sections 32 hold rails 28 in spaced apart parallel position. Rails 28, 30 are disposed in downwardly extending openings on the underside of each frame section 32, with the frame section surrounding each rail on at least three sides, as best seen in FIGS. 2 and 3. This support for the rails, particularly rear rail 30, allows bending brake 22 to be hung from hooks or the like during transport and storage without distorting rail 30.

Each frame section 32 is generally C-shaped in lateral view (FIG. 2). An elongated base member 36 is secured by screws 38 to the forward edge of the lower arms 40 of the several frame sections 32. Base member 36 has a flat upper surface 40 that forms a clamp surface for sheet metal to be bent by the brake. An elongated bend member 42 is pivotally mounted by a hinge rod 44 to base member 36 at a position adjacent to the forward edge of clamp surface 40. A bar or arm 46 is pivotally mounted by a bolt 48 to upper arm 50 of each frame section 32. An elongated anvil member 52 interconnects the forward ends of the several arms 46, being secured thereto by the screws 54. A handle opening 55 extends through each arm 46 at the forward end of the arm adjacent to anvil member 52 for grasping and carrying the sheet bending brake by a user. Arms 46 are pivotal with respect to frame sections 32 under control of a handle 56, as will be described, to bring anvil member 32 into opposed clamping engagement with clamp surface 40 of base member 36. With sheet metal clamped between anvil 52 and base member 36, bend member 42 may be pivoted upwardly by an operator to bend the sheet metal over the forward edge of anvil member 52.

Bend member 42 in the preferred embodiment of the invention takes the form of an elongated extrusion having a downwardly open channel 58 formed along the back side adjacent to base member 36. A pair of longitudinally spaced handles 60 (FIGS. 2–4 and 6) each have an upper end disposed in channel 58 and pivotally secured to bend member 42 by a bolt 62. A spring washer 64 is captured in compression around bolts 62 between handles 60 and an opposing interior surface of channel 58. The upper end of each handle 60 is chamfered, as at 66 in FIG. 4. Each handle 60 preferably comprises an elongated hollow extrusion in which chamfer 66 is formed in an operation after the extrusion has been cut to length. Thus, each handle 60 is pivotal with respect to bend member 42 from a lowered position illustrated in FIGS. 2–4 and 6, in which the handles may be raised by an operator to pivot bend member 42 around hinge rod 44 and bend sheet material over the surface of anvil member 52, and a raised position in which each handle 60 is entirely concealed within channel 58 (FIG. 1). In this raised position, the handle will be above the plane defined by the lower edges of rails 28, 30, and will not interfere with carrying of the bending brake or support of the brake on rails 28, 30 on the bed of a truck, for example. This handle mounting arrangement may be distinguished, for example, from conventional handle mounting arrangements in which the handles must be removed by an operator before transport and storage of the bending brake, in which mounting pins or the like continue to depend from the bend member for possible interference during transport or storage, and in which the handle mounting hardware can become lost during transport and storage. The forces applied by compressed spring washer 64 are sufficient to hold handles 60 in either the lowered or raised position.

Figure 15:
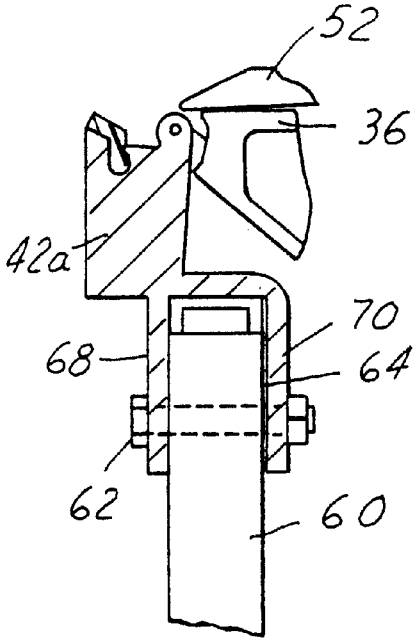
FIG. 15 is a fragmentary sectional view similar to a portion of FIG. 3 but showing a modified embodiment of the invention.

FIG. 15 illustrates a modified embodiment, in which bend member 42*a* has two (or more) longitudinally spaced pairs of depending tabs 68, 70, between which handle 60 and spring washer 64 are secured by bolt 62. The arrangement of FIG. 3, in which handles 60 are entirely enclosed within channel 58 in the raised position of the handles, is preferred both because of the fact that the handles will then be protected from possibly catching against clothes or support structure, and because of the additional rigidity given to bend member 42 by the channel structure.

Figure 9:
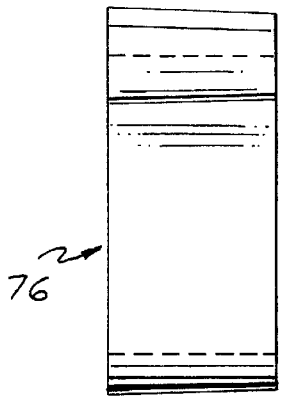
Figure 10:
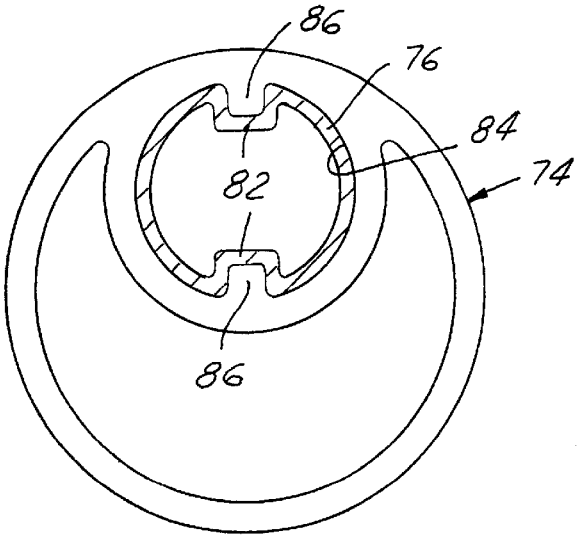
FIG. 10 is a partially sectioned view of the eccentric cam and shaft assembly illustrated in FIGS. 1–2 and 5–7.
Figure 11:
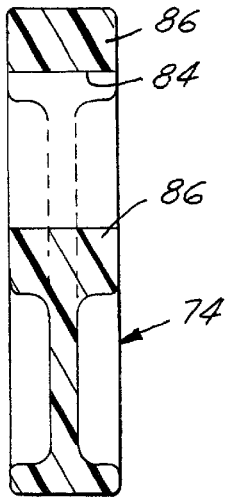
FIG. 11 is a diametric sectional view of the eccentric cam illustrated in FIG. 10.

Handle 56 is coupled to the several anvil support arms 46 by means of an elongated shaft 72 and a plurality of eccentric cams 74 (FIGS. 1–2 and 5–7). Shaft 72 extends through a bearing 76 mounted in each frame section upper arm 50. Each bearing 76 has a tapering outer periphery, as best seen in FIG. 9, that is slidably received within a correspondingly tapering opening in each arm 50. This tapering bearing geometry ensures that each bearing 76 may be inserted into an associated arm 50 in only one direction. Each bearing 76 has a radially extending key 78 that is received within a corresponding slot in the arm opening for aligning the several bearings 76 with respect to each other and with respect to the several frame sections 32. Each bearing 76 has an inner opening 80 that narrowingly tapers in the upward direction when the bearing is mounted in the frame section upper arm. Shaft 72 extends through the aligned openings 80 of the several bearings 76.

Shaft 72 has a pair of diametrically opposed channels 82 integrally formed in the shaft. Each eccentric cam 74 has an opening 84 into which a pair of diametrically opposed lugs 86 radially extend. Cam 74 is of integrally formed construction. Thus, when the several cams 74 are positioned on shaft 76, lugs 86 cooperate with channels 82 automatically to align and time the several cams with respect to each other. This may be distinguished from prior art structures of this general type, in which the cams are mounted on sleeves that are themselves rotationally adjustable with respect to the shaft, rendering alignment and timing of the cams very difficult to accomplish and maintain during use. In assembly of shaft 72, bearings 76 and cams 74, the cams are disposed adjacent to the wide ends of the several bearings, so that the cams hold the bearings in position within the corresponding openings of frame section arms 50. At the same time, cams 74 slidably engage vertically opposed cam surfaces 90, 92 (FIGS. 2 and 5) on each pivot arm 46.

Figure 6:
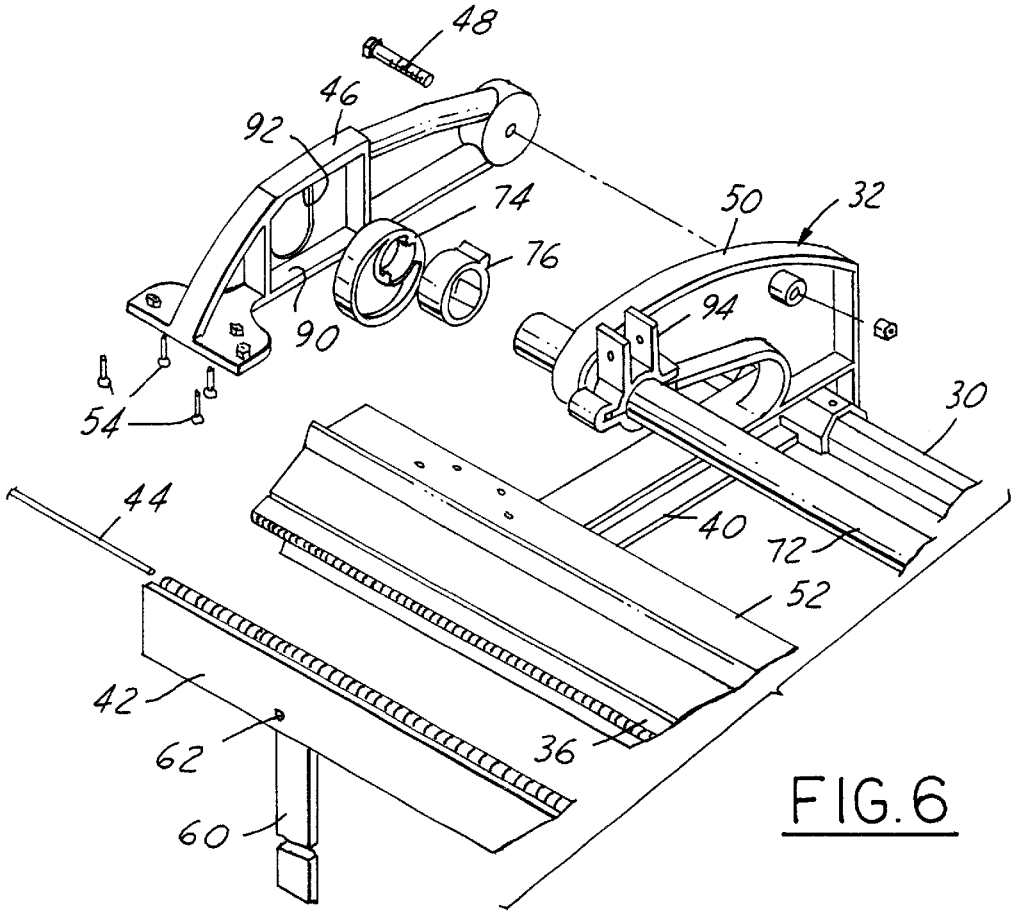
FIG. 6 is a fragmentary partially exploded perspective view of a portion of the sheet bending brake illustrated in FIGS. 1 and 2.
Figure 7:
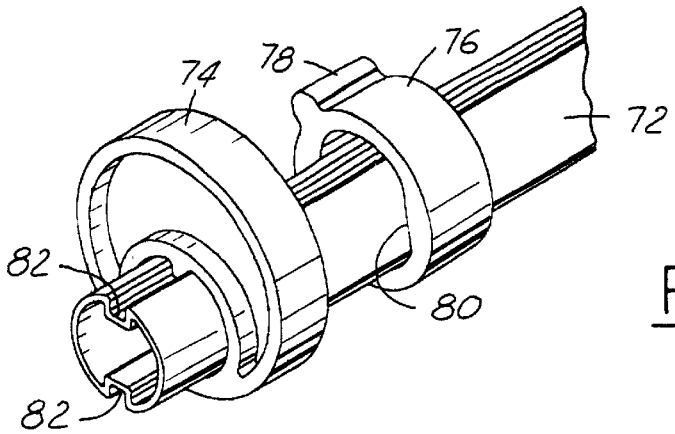
FIG. 7 is a fragmentary perspective view of a portion of the sheet bending brake illustrated in FIGS. 1–2 and 5–6.
Figure 8:
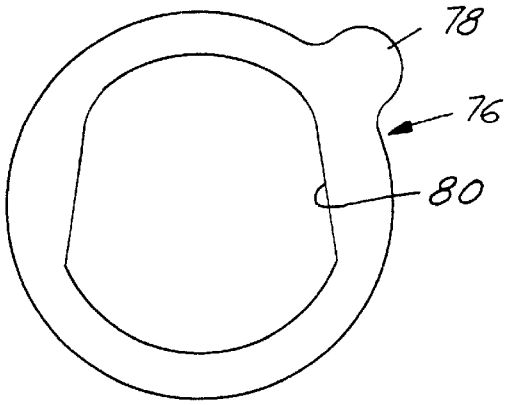
FIGS. 8 and 9 are respective front and side elevational views of the shaft support bearing in the sheet bending brake illustrated in FIGS. 1–2 and 5–7.

Handle 56 is secured to shaft 72 by means of handle mounting brackets 94 (FIGS. 1 and 6). The position of handle 56 with respect to shaft 72 may be adjusted by rotatably adjusting the position of clamps 94 around shaft 72. When handle 56 and shaft 72 are rotated counterclockwise in the drawings, cams 74 push downwardly on the several arms 46 to bring anvil member 52 into clamping engagement with surface 40 of base member 36, and to clamp therebetween the sheet material that is to be bent. When anvil member 52 engages the sheet material against the clamp surface, further motion of handle 56 pulls shaft 72 upwardly within openings 80 of bearings 76. The clamp is locked in position by the action of cams 74 against surfaces 90 and capture of shaft 72 at the upper ends of the bearing openings. After the sheet material has been bent as desired over anvil member 52, handle 56 and shaft 72 are rotated clockwise in the drawings, so that cams 74 lifts arms 46 by engagement with cam surfaces 92 to release the sheet material. Handle 56 and brackets 94 are angularly adjustable with respect to the axis of shaft 72. In this respect, the handle may be adjusted to lock sheet material in the brake by either pulling the handle as described above, or by pushing the handle clockwise in the drawings. Rails 28, 30, members 36, 42, 52 and shaft 72 may be of extruded metallic construction, such as aluminum. Longitudinally extending grooves 82 in shaft 76 are extruded in the shaft at the time of manufacture. Frame sections 50 and arms 46 may be of cast metal construction, such as aluminum. Bearings 76 and cams 74 may be of suitable molded plastic construction, such as nylon.

Figure 12:
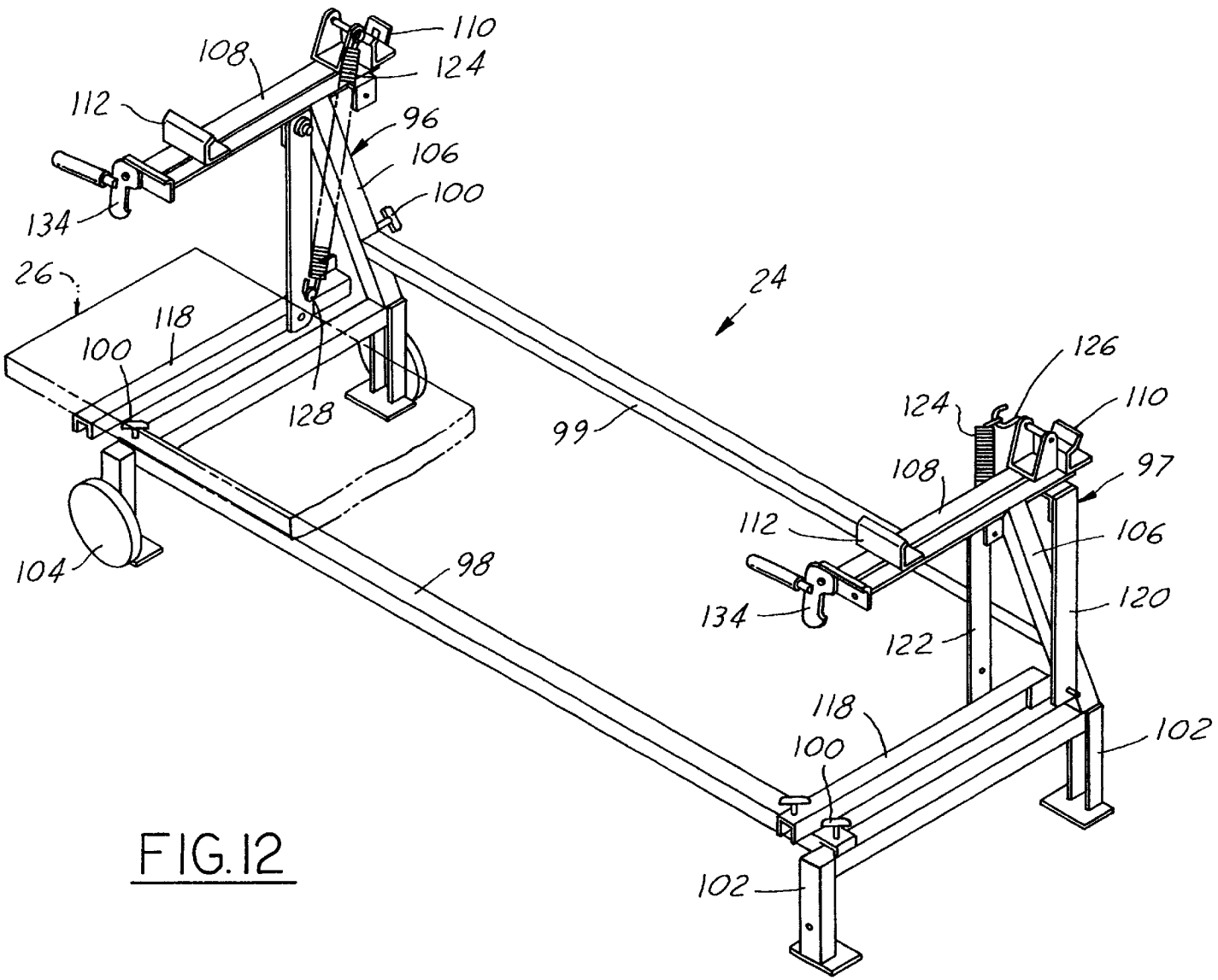
FIG. 12 is a perspective view of the stand and table assembly in the portable sheet bending brake assembly illustrated in FIG. 1, with the sheet bending brake removed for purposes of illustration.
Figure 13:
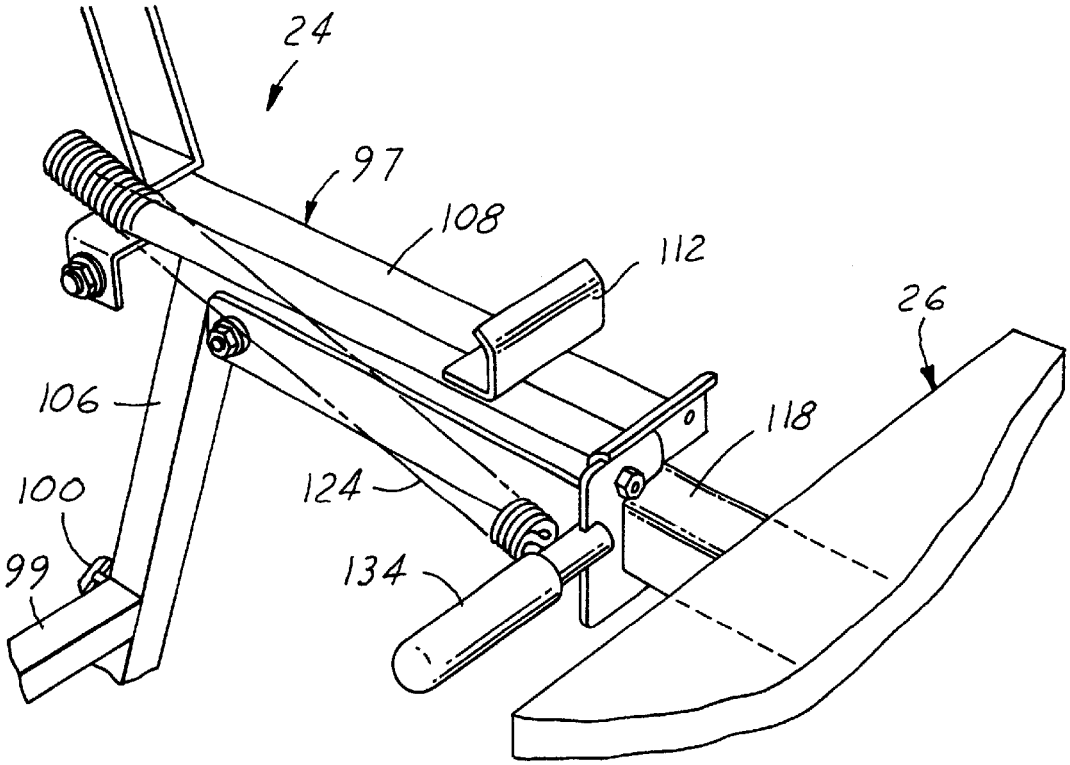
FIGS. 13 and 14 are fragmentary views that illustrate a portion of the stand and table assembly of FIG. 12, with the table in the fully raised position.
Figure 14:
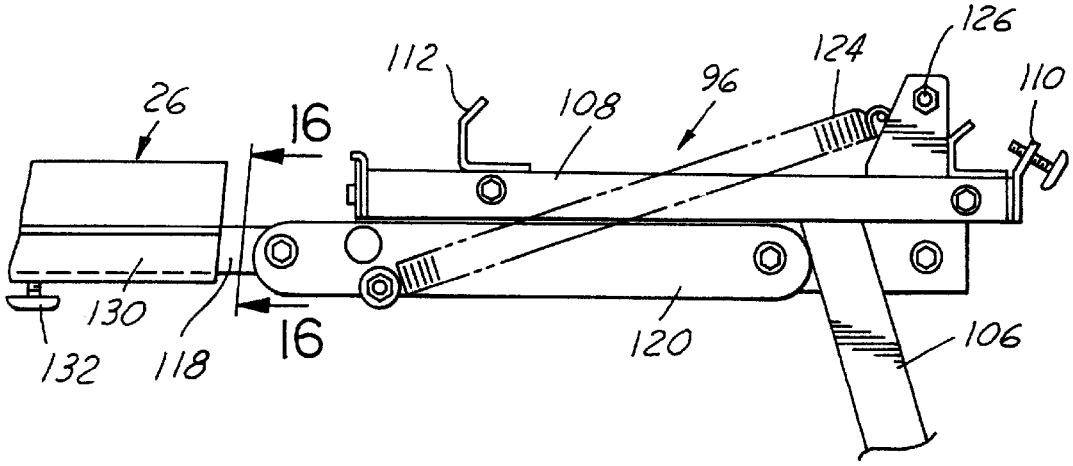

FIGS. 12–14 and 16 illustrate the assembly of stand 24 and table 26 in greater detail. Stand 24 has a pair of leg assemblies 96, 97 that are interconnected by longitudinal bars 98, 99 removably secured by locks 100 (FIGS. 1, 12 and 13). Leg assembly 96 has wheels 104, while leg assembly 97 has legs 102. Otherwise, leg assemblies 96, 97 are essentially mirror images of each other. Each leg assembly includes a leg 106 that extends upwardly from each rear corner of the leg assembly, and a support bar 108 that extends forwardly from the upper end of each leg 106. Each bar 108 carries a bracket 110 and a bracket 112 for engaging rear rail 30 and front rail 28 of bending brake 20 to mount the bending brake in position on the stand. A table support arm 118 is suspended beneath each bar 108 by a rearward link 120 and a forward link 122. Links 120, 122, bar 108 and arm 118 form a multi-bar linkage (preferably but not necessarily a four-bar linkage as shown) for pivoting arm 118 forwardly and upwardly while maintaining arm 118 parallel to bar 108. A coil spring 124 extends in tension between a hook 126 carried by each bar 108 and a pin 128 secured adjacent to the lower edge of each linkage 122. Table 24 has a pair of longitudinally spaced U-shaped channels 130 (FIGS. 14 and 16) secured to the underside thereof. Each channel 130 is slidably received over a corresponding support arm 118, and is removably secured thereto by an appropriate lock mechanism 132. A manual clamp lock 134 is carried at the forward end of each bar 108. Locks 134 engage and hold arms 118 in the fully raised position (FIGS. 1, 13 and 14).

Figure 16:
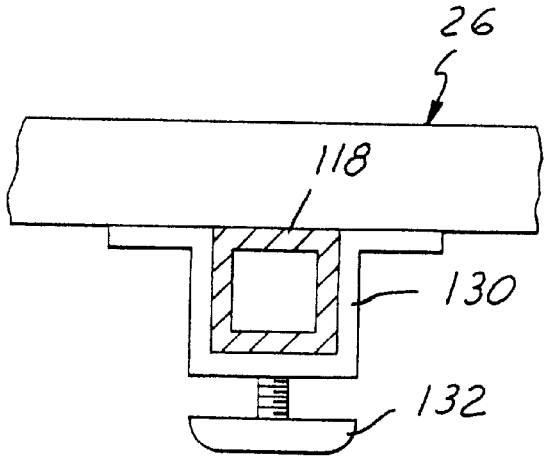
FIG. 16 is a fragmentary sectional view taken substantially along the line 16—16 in FIG. 14.

Thus, table 26 is pivotally mounted by the stand for swinging between a lowered position (FIG. 12) beneath the bending brake mounted on the stand, and a raised position (FIGS. 1, 13 and 14) forwardly adjacent to the clamping members. The table may thus be used to position and mark a piece of sheet material for bending. The four-bar linkage maintains horizontal orientation of table 26 in and between the raised and lowered positions. Springs 124 are secured in an over-center arrangement that urges the table forward and helps hold the table in the raised and lowered position. To disassemble the bending brake and stand assembly, the bending brake may be removed from frame 24. Table 26 is then removed from arms 118 by loosening locks 132 (FIG. 16). Frame 24 may then be disassembled, and all components moved to a truck or other vehicle for transport. The entire assembly may be rapidly reassembled at a new job site.

There has thus been disclosed a portable sheet bending brake, a stand and table assembly for a portable sheet bending brake, and a portable sheet bending brake and table assembly that fully satisfy all of the objects and previously set forth. A number of modifications and variations have been discussed. Other modifications and variations will readily suggest themselves to persons of ordinary skill in the art. The invention is intended to embrace all such modifications and variations as fall within the spirit and broad scope of the appended claims.

What is claimed is:

1. A portable sheet bending brake that includes:

a support frame including a pair of elongated rails and at least two frame sections secured to said rails, said frame sections having downwardly opening pockets on an underside of each frame section that capture said rails on three sides of each of said rails, an elongated base member secured to said frame sections and having a clamp surface, an anvil member mounted on said support frame and movable toward and away from said base member for clamping sheet material against said clamp surface, and a bend member pivotally mounted on said base member for bending over said anvil member the sheet material clamped between said base and anvil members, each of said frame sections having a lower arm secured to said rails and on which said base member is secured, and an upper arm spaced from said lower arm, at least one pivot arm pivotally mounted to each said upper arm and to which said anvil member is secured, an elongated shaft extending between said upper arms and having a non-circular lateral cross section throughout its length, a handle coupled to said shaft, and eccentric cams on said shaft and engaging said pivot arms for pivoting said pivot arms toward and away from said lower arms, said cams being of integrally formed construction and having internal openings of non-circular cross section corresponding to that of said shaft for automatically timing said cams with respect to each other and to said shaft upon assembly of said cams to said shaft.

2. The brake set forth in claim 1 wherein said handle is coupled to said shaft for adjustment angularly of said shaft.

3. The brake set forth in claim 1 wherein said shaft has at least one elongated channel, and wherein each of said cams has a radial lug received in said channel.

4. The brake set forth in claim 3 wherein said shaft has diametrically opposed elongated channels, and said cams have diametrically opposed radial lugs received in said channels.

5. The brake set forth in claim 1 further comprising bearings secured in openings in said upper arms surrounding said shaft, said openings and said bearings having opposed tapering peripheries so that said bearings are insertable into said openings in only one direction.

6. The brake set forth in claim 1 wherein each of said frame sections has a handle opening adjacent to said anvil member for carrying said bending brake.

7. The brake set forth in claim 1 further comprising a stand for mounting said brake, and a table mounted on said stand for movement between a lowered position beneath said brake and a raised position adjacent to said bend member.

8. The brake set forth in claim 1 further comprising at least one handle mounted on said bend member for pivotal motion between a first position in which said handle extends from said bend member for manual operation of said bend member to bend sheet material over said anvil member, and a second position adjacent to and against said bend member for storage and transport of said sheet bending brake.

9. A portable sheet bending brake that includes:

a support frame including a pair of elongated rails and at least two frame sections secured to said rails, an elongated base member secured to said frame sections and having a clamp surface, an anvil member mounted on said support frame and movable toward and away from said base member for clamping sheet material against said clamp surface, and a bend member pivotally mounted on said base member for bending over said anvil member the sheet material clamped between said base and anvil members, each of said frame sections having a lower arm secured to said rails and on which said base member is secured, and an upper arm spaced from said lower arm, at least one pivot arm pivotally mounted to each said upper arm and to which said anvil member is secured, an elongated shaft extending between said upper arms and having a non-circular lateral cross section throughout its length, a handle coupled to said shaft, eccentric cams on said shaft and engaging said pivot arms for pivoting said pivot arms toward and away from said lower arms, said cams being of integrally formed construction and having internal openings of non-circular cross section corresponding to that of said shaft for automatically timing said cams with respect to each other and to said shaft upon assembly of said cams to said shaft, a stand for mounting said brake, and a table mounted on said stand for movement between a lowered position beneath said brake and a raised position adjacent to said bend member.

10. The brake set forth in claim wherein said frame sections have downwardly opening pockets on an underside of each frame section that capture said rails on three sides of each of said rails.

11. The brake set forth in claim 9 wherein said stand includes a four-bar linkage mounting said table to said stand for maintaining orientation of said table between said lowered and raised positions.

* * * * *